United States Patent [19]

Moody

[11] Patent Number: 4,786,044

[45] Date of Patent: Nov. 22, 1988

[54] INSERT FOR ADJUSTABLE SHEET GUIDE

[75] Inventor: Philip L. Moody, Cranbury, N.J.

[73] Assignee: General Electric Company, Schenectady, N.Y.

[21] Appl. No.: 22,844

[22] Filed: Mar. 6, 1987

[51] Int. Cl.[4] ..... B65H 1/06

[52] U.S. Cl. ..... 271/171

[58] Field of Search ..... 271/171, 99, 23, 132, 271/144

[56] References Cited

U.S. PATENT DOCUMENTS

| | | | |
|---|---|---|---|
| 3,334,893 | 8/1967 | McCall | 271/171 X |
| 3,807,725 | 4/1974 | Bookless | 271/171 |
| 3,934,870 | 1/1976 | Miller et al. | 271/164 |
| 3,936,044 | 2/1976 | Kramer | 271/122 |
| 4,343,461 | 8/1982 | Tomimori et al. | 271/22 |
| 4,436,469 | 3/1984 | Kelly | 271/171 X |
| 4,575,067 | 3/1986 | Ciatteo | 270/58 |

FOREIGN PATENT DOCUMENTS

| | | | |
|---|---|---|---|
| 227636 | 12/1984 | Japan | 271/171 |

OTHER PUBLICATIONS

Xerox Disclosure Journal, vol. 4, No. 5, Sep./Oct. 1979, pp. 627, 628, "Paper Tray Side Guides", Bernard J. Riley.

"Aligning Paper Tray," by W. E. Allen et al., *IBM Technical Disclosure Bulletin,* vol. 19, No. 9, Feb. 1977, p. 3290.

*Primary Examiner*—Richard A. Schacher

*Attorney, Agent, or Firm*—William Squire; James C. Davis, Jr.; Paul R. Webb, II

[57] ABSTRACT

Two parallel guide rails slidably receive corresponding mating members which together form two spaced sheet material guides. A rod including a guide member is slidably attached to the rails and members for displacement in directions along the rails. The rails having relatively small footprints on a perforated plate which holds the bottom sheet of a sheet material stack aligned by the rails and guide member without interference with sensors and a feed mechanism downstream and adjacent to the perforated region.

6 Claims, 2 Drawing Sheets

INSERT FOR ADJUSTABLE SHEET GUIDE

This invention relates to adjustable guides for sheet material, and, more particularly, to apparatus for aligning a stack of sheet material for use with electrophotographic printing machines.

Electrophotographic printing machines, generally referred to as copy machines, and similar type of apparatus which employ sheet material, for example, stacks of sheet paper stock, include a feed mechanism for feeding the sheets seriatim from the stack into the machine. The stack of sheets are aligned with the apparatus by an adjustable guide which compensates for the width and length of the stack, holding the stack in place during the feed process. Such sheet guides employ adjustable side and rear walls movably attached to a base plate. Examples of such guides are illustrated in U.S. Pat. Nos. 3,807,725; 3,934,070; 3,936,044; 4,343,461; and 4,575,067.

U.S. Pat. No. 4,343,461 relates to a paper feeding cassette for receiving paper piles of different widths. Another form of an adjustable guide is of the type disclosed in U.S. Pat. No. 4,575,067 which includes an insert useful with a collating machine stacking bin. Both the cassette, insert, and other adjustable guides all have the common structure of a base plate to which adjustable means are attached for aligning the sheet material in the stack at the length edges and width edges.

Electrophotographic printing or copy machines usually have feed and stack alignment systems for the sheet material built into the machine at the beginning of the printing process. One such machine employs the cassette guide discussed above. A second type of machine known as the 9500 Automatic Document Handler, manufactured by Xerox Corp. includes a stacking sheet alignment mechanism which is integral with the machine at the beginning of the sheet material feed path. This machine, illustrated in FIG. 1 herein, includes a stacking region in which a base plate is perforated and in communication with a vacuum to hold the lowermost sheet of the stack in place during the sheet feeding cycle. The machine further includes guides for each of the length edges of the stack parallel to the feed path, and a gear guide (all of the guides being adjustable). This apparatus also includes a mechanism for feeding the lowermost sheet of the stack into the machine and also includes other mechanisms for returning the processed sheet back into the stack. This apparatus is discussed more fully in the description of the present invention later.

The problem with the sheet feeding system of this apparatus is that the sheet stacking guides, while integral with the machine, are not capable of stacking sheet material of a large range of length and width dimensions. More particularly, the machine employs length and width guides which are not capable of handling a sheet stock of relatively small dimensions, e.g., less than 8"×10". It is important that such stacks be properly aligned in the machine because such a machine also employs sheet material sensors as well as document feeding devices which require relatively good alignment of the bottommost sheet of the stack with the feed system. Should the stack be somewhat misaligned with the feed systems, then the entire printing process is upset and the process needs to be rejected and the stack realigned. The system is not readily adaptable for use with commercially available cassette type guides because of the requirement that the lower plate, with its perforated holes for vacuum grasping the lowermost sheet, needs to be in contact with the lowermost sheet. The commercially available cassettes and similar structures may also interfere with the operation of the sensors and the document feed mechanism of this particular machine.

A sheet material adjustable guide insert according to the present invention provides an unobstructed stacking region for the stack on a support. The insert includes first and second stack aligning members each having a stack aligning surface. A third stack aligning member has a stack aligning surface. The first and second members include means for adjustably receiving the third member so that the first and second members are secured with their aligning surfaces parallel to each other and normal to the aligning surface of the third member. The means for adjustably receiving includes adjustment means for allowing the spacing distance between the first and second members to be changed in a first direction and the position of the third member in a second direction parallel to the first and second member aligning surfaces. All of the members are constructed so that the stacking space region defined by the aligning surfaces is substantially unobstructed in a direction parallel to all aligning surfaces.

Figure 1:
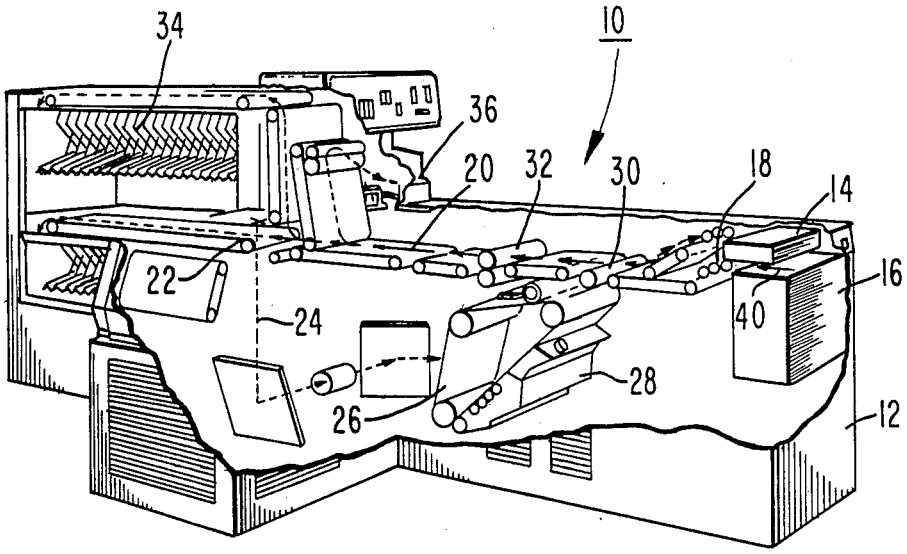
FIG. 1 is a perspective view of a electrophotographic printing machine of the type in which an embodiment of the present invention is used.

In FIG. 1, electrophotographic printing machine 10 comprises a housing 12 and means (not shown in FIG. 1) for receiving a first stack 14 and a second stack 16 of sheet material on which an image is to be printed. The stacks 14 and 16 may be paper or other sheet materials. The sheet material from stack 14 is fed by feed system 18, FIG. 2. It is this feed system 18 which is of interest and in which the embodiment of the present invention is employed.

The machine 10 feeds the bottommost sheet or document from the stack 14 via the feed system 18 in the feed path arrow 20. When the document being copied is over a support transparent glass 22, the document is flash exposed. The document image is transmitted through a lens and mirror system (represented by dotted line 24) to a photoreceptor belt 26.

Initially, the image on the belt is an invisible charged area. As the belt 26 moves through the machine's developer system 28, the charged area attracts dry ink to it. At this point there is a visible reverse image on the belt 26. The belt then passes under a roll where the image is transferred to the sheet material. The sheet material continues along the path of arrow 20 to a fuser 32. The image is melted and bonded to the sheet material. If an image is to be placed on both sides of the sheet material, the sheet material is returned to an auxiliary (not shown) where it waits for a second pass through the system. In the latter case, the sheet material is returned to stack 14. The sheet material of the single pass mode moves to a sorting system 34 and a receiving tray 36 where it is stored until removed. In the interim, the belt 26 is continuously moving and passes under a corotron which removes the charge from it and under a brush which sweeps off leftover dry ink. The dry ink is filtered and returned to the system for reuse. The photoelectric printing machine described above is compressively available and is given by way of illustration to show the environment of the present invention.

Figure 2:
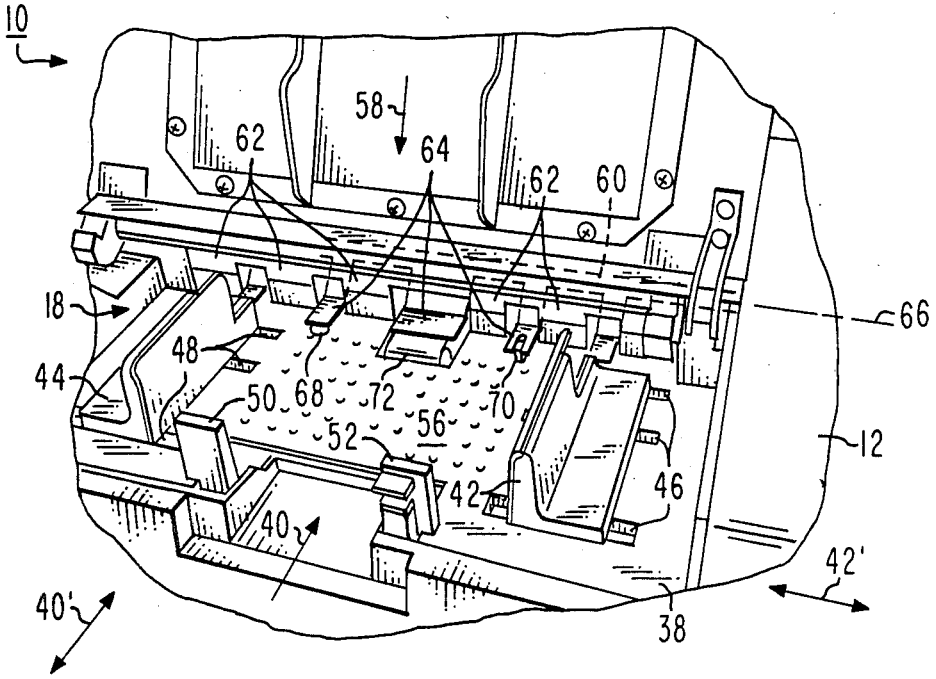
FIG. 2 is an isometric view of the sheet material stack adjustable guide system of the machine of FIG. 1.

In FIG. 2, the feed system 18 of apparatus 10 is relatively complex. It is to be understood that the feed system 18 is employed for the stack 14; a second different feed system (not shown) is employed for feeding the stack 16 (FIG. 1). Referring to FIG. 2, the feed system 18 includes a perforated stack support plate 38 on which a stack of sheet material (such as paper or other material) is placed for feeding into the machine 10 in direction 40. The feed system 18 further includes adjustable mirror image identical adjustable guides 42 and 44. Guide 42 is displaceable in transverse directios 42' by its attachment to slots 46 in plate 38. Similarly, guide 44 is also movable in directions 42' by its attachment to slots 48 in plate 38. Guides 44 and 46 are manually displaced. A second set of guides 50 and 52 are secured to the housing 12 for displacement in directions 40' normal to directions 42'. Guides 50 and 52 are also manually displaced. The central region 56 of plate 38 between the guides 42, 44, 50, and 52 is perforated. Beneath plate 38, in communication with the perforations of region 56, is a system for evacuating a chamber resulting in ambient atmospheric air being forced into the apertures of plate 38 in region 56 in direction 58. The purpose of the apertures and the vacuum in region 56 is to hold the bottommost sheet of the stack 14 (FIG. 1) in place until it is picked up and fed by feeder mechanism 60.

The feeder mechanism 60 includes fixed vertical barrier plates 62. Between the barrier plates 62 are document feed fingers 64. Fingers 64 are connected to a common mechanism and rest over a stack being fed into the feed mechanism 18. The stack rests against plates 62 beneath fingers 64 and on plate 38. A sheet feed device 72 feeds the lowermost sheet, one at a time, in direction 40 into the machine path 20 (FIG. 1). The document feed fingers 64 need to be free of any restraining objects, such as the guides 42, 44, or other objects. Physical contact of objects with the fingers 64 interfere with their operation. The fingers initially are beneath the stack and when set in motion move over the stack forward edge holding the stack against plate 38. A photoelectric sensor 68 is beneath one of the fingers 64 and a mechanical trigger switch 70 is beneath another of the fingers 64 and sense the presence of the stack. Recall that in some cases, the processed documents are returned to the top of stack 14. Machine 10 includes a system (not shown) for stopping the process when the last sheet of stack 14 is processed.

The photoelectric sensor 68 and the trigger switch 70 are employed for sensing that the stack is present and ready to be fed into the system. The sensor and trigger do not permit sheet material smaller than 5½ inches wide to 7 inches in length. If the document is not oriented properly or present, the system automatically stops. The coupling of the photoelectric sensor 68 and the switch 70 and the operation of the feed system 18 is not given here, as these are part of the commercial apparatus whose details are known and, therefore, need not be described herein. The important consideration is that no object should touch the sensor 68, the switch 70, or the document feed fingers 64 other than the sheet material fed into the system. The physical contact of guides 42 and 44 with this feed mechanism will halt the system, due to the presence of the sensor, switch, and other sensors (not shown) in the system.

The problem with this system is that because of sensors and feed fingers and the need for the perforations in region 56, the guides 42 and 44; 50 and 52 are not capable of aligning and stacking relatively small dimensioned sheet material, for example, less than 10" width material between guides 42 and 44 or less than 8" in length between guides 50 and 52 and plates 64. Often, materials of smaller dimensions need to be processed on the machine 10. Because the guides of the machine 10 will not properly align such smaller dimensioned stacks, the machine cnanot process those documents accurately, often misaligns them, causing poor reproduction.

An adjustable guide insert according to one embodiment of the present invention is insertable in the region 56 for guiding a stack of sheet material which is dimensioned less than the minimum width accepted by guides 42 and 44, permits the region 56 to function in its normal design capability of holding the bottommost sheet in place via a vacuum, and does not interfere with the feed mechanism 60, including fingers 64, sensor 68, and switch 70.

Figure 3:
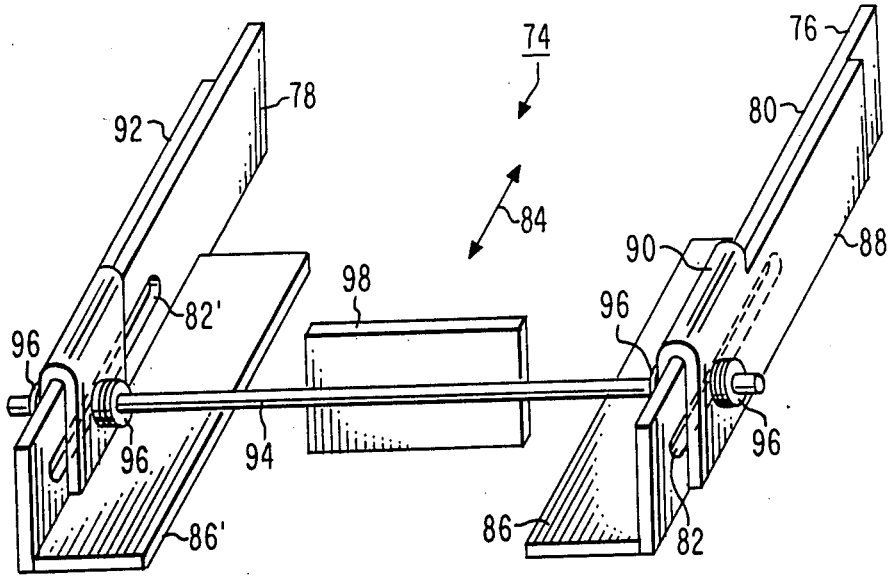
FIG. 3 is an isometric view of a sheet material stack adjustable guide insert according to one embodiment of the present invention.

In FIG. 3, an adjustable insert 74, according to one embodiment of the present invention, comprises first and second sheet material rails 76 and 78 of like, but mirror image, dimension. Rail 76 comprises an elongated, rectangular member 80 in which there is an elongated slot 82 which extends in parallel to directions 84. A like slot 82' is in rail 78. Extending perpendicular to the plane of member 80 is a foot 86. Foot 86 extends from rail 76 a relatively short dimension to provide a relatively small footprint on a supporting surface on which the foot is placed.

An inverted slider 88 includes a leg 90 forming a U-shaped channel with the main body of slider 88. The slider 88 channel receives member 80 and slides along the upper edge of member 80. Slider 88 has a circular aperture (not shown) therein axially aligned with a second aperture (not shown) in leg 90 which receives a circular rod 94. The aperrtures of slider 88 and leg 90 are aligned with slot 82 so that the rod 94 passes through the apertures and slot 82. A pair of rubber grommets 96 are on each side of the respective apertures of leg 90 and slider 88 to slidably receive the rod 94 and adjustably hold it in position. The rail 78 includes an identical slider 92 and a foot 86'.

A plane sheet material guide member 98 is secured to rod 94. Member 98 has a stack aligning surface 98'. Member 80 and its counterpart of rail 78 have inner facing stack alignment surfaces which cooperate in conjunction with surface 98' to provide stack alignment.

Figure 4:
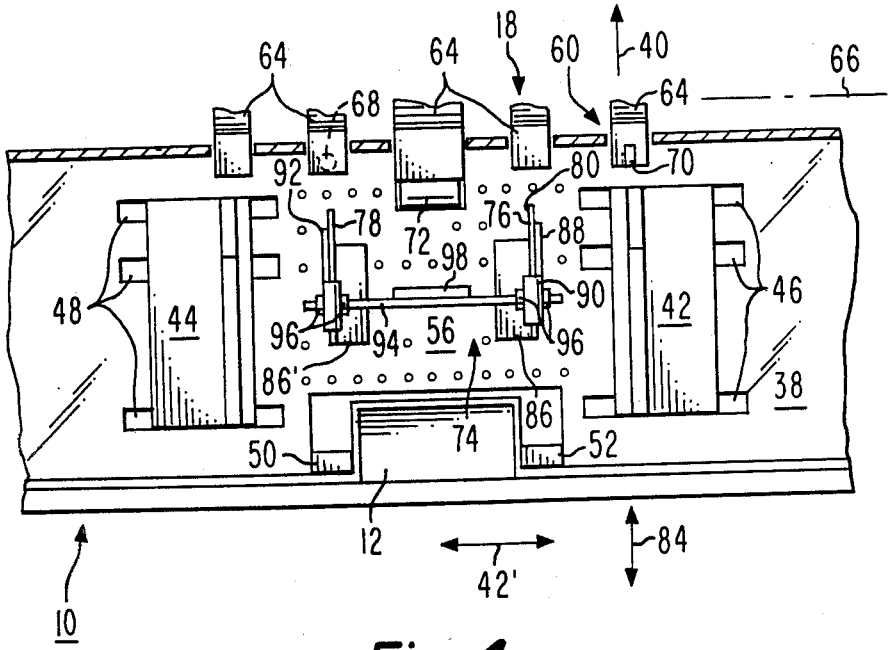
FIG. 4 is a plan view of the machine of FIG. 1 with the insert of FIG. 3 in place.

In operation, insert 74, FIG. 4, is placed with the feet 86 and 86' resting on the perforated plate 38 with the region 56 central thereof. The footprints of feet 86 and 86' are relatively small compared to the magnitude of the region 56 so that a significant portion of the region 56 is exposed to ambient atmosphere. The position of rails 76 and 78 is adjusted in the transverse directions 42' so that the inner facing surfaces of rails 78 and 76 and member 92 abut the sheet material stack to be guided by the insert 74. Member 98 is moved in directions 84 to abut the sheet material stack. The rails 76 and 78 are sufficiently short in direction 84 so that they can be positioned spaced from the fingers 64 and the sensor 68 and the trigger 70 so as not to interfere with the feed system 18. The guides 42 and 44 are moved in transverse directions 42' until they abut the ends of rod 94.

The insert assembly comprising the rod 94 and the rails 76 and 78 is relatively flimsy. The abutment of guides 42 and 44 help stabilize the insert. Also, the legs 86 and 86' also serve to stabilize the insert somewhat. However, the stability of the rails to the rod 94 is of relatively small importance as the presence of these elements and the friction engagement of the rod 94 to the rails via the grommets 96 is sufficient to provide significant guidance to the sheet material stack abutting thereagainst.

The feet 86 and 86', while desirable, are not essential to the operation of the insert 74. To further reduce the footprint of the insert over region 56, the feet 86 and 86' may be removed so that only surfaces normal to the support plate 38 are mounted on the plate 38. This provides a minimum footprint over the perforated region 56. The insert 74 is aligned with the member 98 perpendicular to directions 84 by eye. Such alignment is sufficient to align a sheet material stack for use in the machine 10. The adjustment of the rails 76, 78, and rod 94 can accommodate sheet material stacks of almost any dimension from a relatively small transverse width dimension in directions 42' to a dimension within the range of guides 42 and 44 such that there is a continuous accommodation of sheet material widths from the maximum dimension of guides 42 and 44 to a narrow width which accommodates almost all combinations of sheet material stack widths.

It is to be understood that the particular construction of the insert 74 is given by way of illustration rather than limitation and that the insert 74 is but one embodiment of the present invention.

What is claimed is:

1. A sheet material stack adjustable guide insert for providing an unobstructed stacking region for said stack on a support comprising:

a first stack aligning member having a stack aligning surface and adapted to rest on said support;

a second stack aligning member having a stack aligning surface and adapted to rest on said support; and a third stack aligning member having a stack aligning surface, said first and second members including means for adjustably receiving the third member so that the first and second members are secured with their aligning surfaces parallel to each other and normal to the aligning surface of the third member, said means for adjustably receiving including adjustment means for adjusting the spacing distance between the first and second members in a first direction and the position of the third member in a second direction parallel to the first and second member aligning surfaces, the footprint of all said members on said support being relatively small compared to the stacking space region defined by said aligning surfaces so that said latter space is substantially unobstructed in a direction parallel to all said aligning surfaces;

said first and second members each comprising a sheet material element having a slot extending in said second direction, and a second sheet material element having a U-shaped section straddling the first element, and said third member including a rod releasably secured to the Ushaped section and passing through said slot.

2. The insert of claim 1 wherein said first and second members include parallel corresponding slots extending in said second direction, said third member including means engaged with said slots arranged such that said third member is movably attached to said first and second members at said slots for relative displacement thereto in said first and second directions.

3. The insert of claim 1 wherein said third member comprises a sheet material element secured to said rod.

4. The insert of claim 1 wherein said first and second members each include a foot extending normal therefrom a distance relatively small as compared to the spacing between said first and second member aligning surfaces.

5. A sheet material stack adjustable guide insert comprising:

a first sheet element having an elongated slot extending in a first direction;

a first U-shaped member straddling the sheet element, said member having a pair of spaced facing walls juxtaposed with said slot, each wall having a hole therein aligned with the hole in the other wall and the slot;

a second sheet element of like construction and mirror image of the first element;

a second U-shaped member straddling the second element and of like construction and mirror image of the first member;

a rod slidably secured to the first and second members passing through said slots and holes; and a stack guide member secured to the rod and having an alignment surface normal to the first direction.

6. The insert of claim 5 wherein said insert includes a set of rubber grommets slidably frictionally secured to the rod on each side of said members.

* * * * *